US006719121B2

(12) United States Patent
Alexander et al.

(10) Patent No.: US 6,719,121 B2
(45) Date of Patent: Apr. 13, 2004

(54) COIN COLLECTION CART FOR PARKING METERS

(75) Inventors: Dennis Alexander, Surrey (CA); Gil Somerville, Surrey (CA); Bruce Larsen, West Vancouver (CA); Matthew Murnaghan, North Vancouver (CA)

(73) Assignee: City of Vancouver and Cypress Solutions Inc., Vancouver (CA)

( * ) Notice: Subject to any disclaimer, the term of this patent is extended or adjusted under 35 U.S.C. 154(b) by 0 days.

(21) Appl. No.: 09/813,460

(22) Filed: Mar. 20, 2001

(65) Prior Publication Data

US 2002/0134645 A1 Sep. 26, 2002

(51) Int. Cl.[7] ..... G07F 9/06
(52) U.S. Cl. ..... 194/350; 232/15
(58) Field of Search ..... 194/350, 351; 232/15, 16; 453/17

(56) References Cited

U.S. PATENT DOCUMENTS

| | | | | | |
|---|---|---|---|---|---|
| 1,011,815 | A | * | 12/1911 | Kohler | 232/15 |
| 2,815,166 | A | * | 12/1957 | Sollenberger | 232/16 |
| 3,961,744 | A | * | 6/1976 | Kashuba, Jr. | 232/16 |
| 4,380,316 | A | | 4/1983 | Glinka et al. | 232/16 |
| 4,398,550 | A | * | 8/1983 | Shireman | 453/32 |
| 4,471,905 | A | | 9/1984 | Sloma et al. | 232/12 |
| 4,729,509 | A | * | 3/1988 | Diekhoff | 232/16 |
| 4,730,117 | A | | 3/1988 | Zack | 250/568 |
| 4,829,296 | A | | 5/1989 | Clark | 232/7 |
| 5,259,491 | A | | 11/1993 | Ward II | 194/350 |
| 5,458,285 | A | | 10/1995 | Remien | 194/350 |
| 5,564,546 | A | * | 10/1996 | Molbak et al. | 194/216 |
| 5,619,932 | A | | 4/1997 | Efland | 194/350 |
| 5,830,054 | A | * | 11/1998 | Petri | 221/281 |
| 5,875,879 | A | | 3/1999 | Hawthorn | 194/350 |
| 5,941,364 | A | * | 8/1999 | Wei | 194/350 |
| 5,997,396 | A | * | 12/1999 | Itako | 453/17 |
| 6,082,519 | A | * | 7/2000 | Martin et al. | 194/350 |
| 6,261,169 | B1 | * | 7/2001 | Ishida et al. | 194/350 |
| 6,318,537 | B1 | * | 11/2001 | Jones et al. | 194/346 |
| 6,336,544 | B1 | * | 1/2002 | Blad et al. | 194/217 |

FOREIGN PATENT DOCUMENTS

| | | | | |
|---|---|---|---|---|
| CA | 0615715 | * | 3/1961 | 194/350 |
| CA | 667411 | * | 7/1963 | 194/350 |
| DE | 2417683 | * | 10/1974 | 194/350 |
| EP | 03919302 | | 10/1990 | |

* cited by examiner

*Primary Examiner*—Eileen D. Lillis
*Assistant Examiner*—Paul T. Chin
(74) *Attorney, Agent, or Firm*—John Russell Uren

(57) ABSTRACT

A coin collecting cart for collecting coins from parking meters. A plurality of bins are used, each bin being limited to a certain quantity of coins which quantity of coins is electronically sensed. When the first of the bins is full of coins, the coins pass to the second of the bins and so on. When the bins are full, they are individually removable from the cart and mountable within a frame located remotely from the cart. The bins are unloaded by manually rotating the frame together with the bin about an axis.

3 Claims, 8 Drawing Sheets

COIN COLLECTION CART FOR PARKING METERS

INTRODUCTION

This invention relates to a coin collection cart and more particularly, to a high security coin collection cart used for emptying coins from parking meters.

BACKGROUND OF THE INVENTION

Coin collection carts for parking meters are well known. They make the rounds from parking meter to parking meter collecting the coins that are inserted into the parking meters by motorists in municipalities. The coins collected by the cart are transported to a bank or other secure location where they are unloaded. The amount of money generated from parking meters is often a highly significant source of funds for municipalities and the amount of cash collected from a single coin collection cart in a day can amount to many thousands of dollars in busy locations.

It follows that security is a principal concern of parking meter coin collection. The security involved generally involves the security of the coins themselves after the collection of the coins from the parking meter and it also involves pilferage during the coin collection process. Other considerations involve ergonomics, such as the weight of the coins collected during coin unloading and the ease of the unloading operation. Furthermore, the operation of the cart itself has received surprisingly little attention. On hilly terrain, for example, the cart must be secured when the operator is attending to the parking meter and the weight of the cart, particularly during the later stages of coin collection when the cart is heavy with coins, is significant. Interaction between the operator and the coin cart during cart operation is important.

Heretofore, the design of coin carts has been relatively consistent. This has been the case because parking meter design has been consistent, a typical parking meter holding a cylindrical cannister which holds the coins inserted by the motorist parking within the meter space. The coin cart operator opens the meter with a high quality key and removes the cannister. The cannister containing the coins is inserted into a receptacle on the top of a locked strongbox. The cannister is typically rotated which opens a closed window on the cannister and allows the coins within the cannister to drop into the strongbox. The empty cannister is rotated to its original position, removed from the receptacle on the top of the strongbox and reinserted into the parking meter. The meter is closed. Generally, it is difficult to access the coins within the strongbox until the cart is transported to a secure location where the strongbox is removed from the cart and unlocked. The strongbox is inverted and the coins within the strongbox are dumped into a receptacle or receiving bin for counting and further processing.

The weight of the strongbox when it is loaded with coins is significant, sometimes weighing close to eighty (80) or one hundred (100) pounds. To remove the strongbox from the cart, two men may be required to ease the load. If the strongbox is required to be inverted, it can be difficult for a single operator which is disadvantageous.

A further problem is that access to the coins in the strongbox, although difficult, may not be impossible. For example, a magnetic and flexible rod may be inserted into the strongbox and coins removed after they affix themselves to the magnet. The compromise to coin security is not conducive to entirely satisfactory operation of the coin cart relating to the suspicion of pilferage.

Most prior art coin carts have two wheels and a stop on the bottom of the cart which form a tricycle type support arrangement. When the cart is at rest, the stop is in contact with the ground. When the cart is to be moved, the operator rotates the control handle of the cart and rotates the cart itself about the axis of the two wheels. If the cart is moving uphill, significant weight is transferred to the operator making movement of the cart unnecessarily difficult.

To reduce the weight required to be manipulated by the operator during unloading, canvas bags have been used. The coins fall into a first bag until the operator senses though experience that the bag has reached its desired weight. The operator will open the strongbox, close the first bag and place it in the bottom of the strongbox. He will open a second bag and place it on top of the first full bag. While this reduces the weight required to be manipulated during the unloading operation, it does not enhance and indeed lessens security since the operator can access the interior of the strongbox during coin collection.

SUMMARY OF THE INVENTION

According to one aspect of the invention, there is provided a coin cart for parking meter collection comprising a coin receiving receptacle and at least two collection bins for receiving coins from said coin receiving receptacle, each of said collection bins holding a predetermined quantity of coins, each of said collection bins having an opening which is open during said coin receiving and which is closed following removal of said collection bin from said coin cart.

According to a further aspect of the invention, there is provided a coin receiving receptacle fixed on a coin cart, said coin receiving receptacle being rotatable by a cannister inserted within said coin receiving receptacle, said coin receiving receptacle and said cannister each having an opening, said opening in said cannister allowing access to said opening in said receptacle during said rotation of said cannister within said receptacle, said receptacle having a locking mechanism allowing rotation of said receptacle during insertion and rotation of said cannister and not allowing rotation of said receptacle when said cannister is not present within said receptacle.

According to a further aspect of the invention, there is provided a coin holder for holding coins collected during parking meter coin collection, said coin holder having an opening to allow coins to be collected by said holder through said opening and a sensor for sensing a predetermined quantity of said coins within said coin holder.

According to yet a further aspect of the invention, there is provided a coin collection receiving device for receiving coins collected from a parking meter, said coin collection receiving device comprising a coin chute to allow said coins to be transferred from a coin receiver to at least two receiving bins, said coin chute being operable to allow said coins to be transferred from one of said receiving bins to a second of said receiving bins upon a predetermined quantity of said coins being sensed within said first one of said receiving bins.

According to still yet a further aspect of the invention, there is provided an unloading device for a parking meter coin collection cart, said unloading device including a frame operable to receive a coin holder, said frame being rotatable to allow said coin holder to be rotated from an upright to an inverted position.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1A:
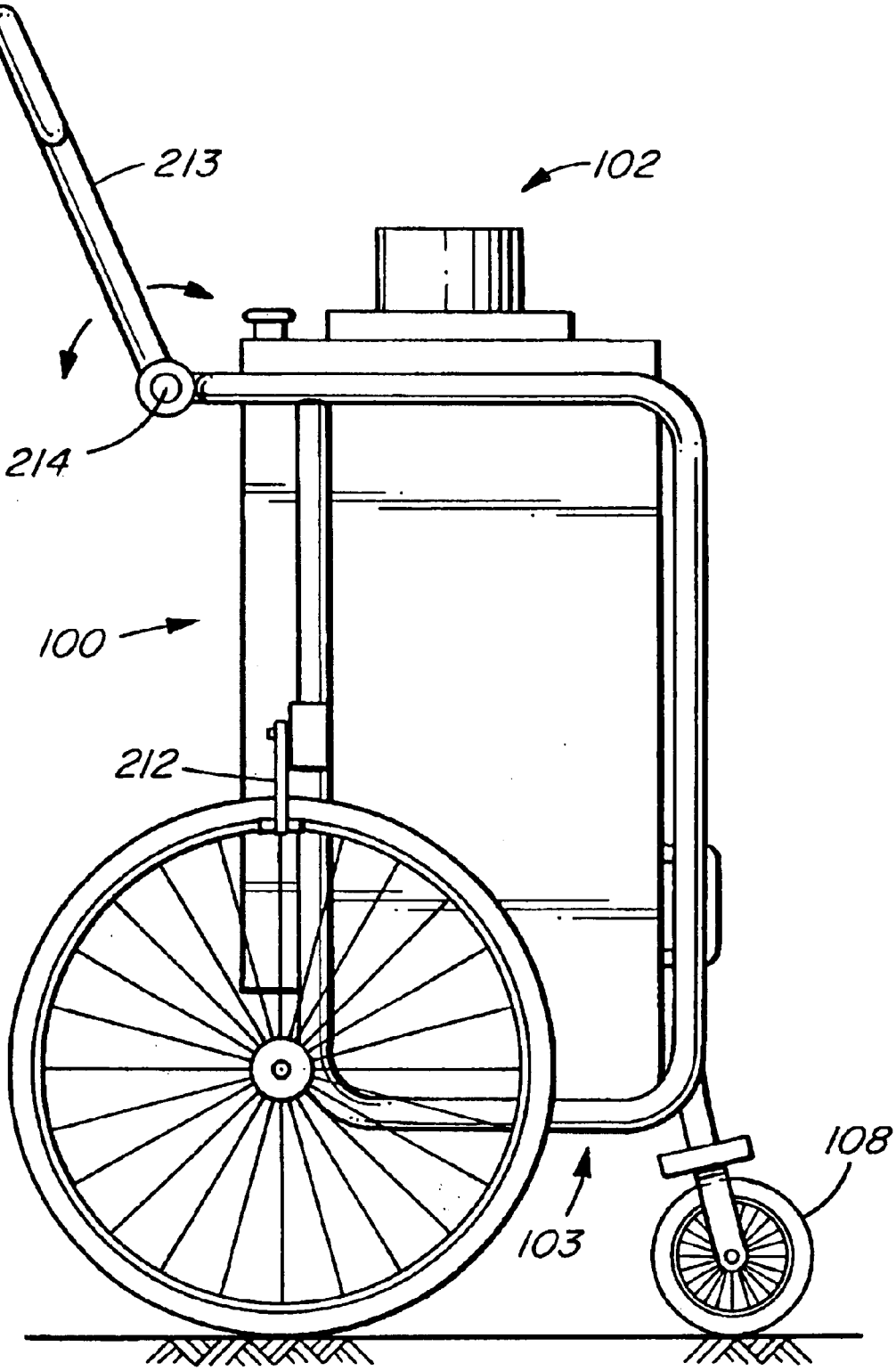
FIGS. 1A and 1B are diagrammatic side and front views, respectively, of the coin collection cart according to the invention.
Figure 1B:
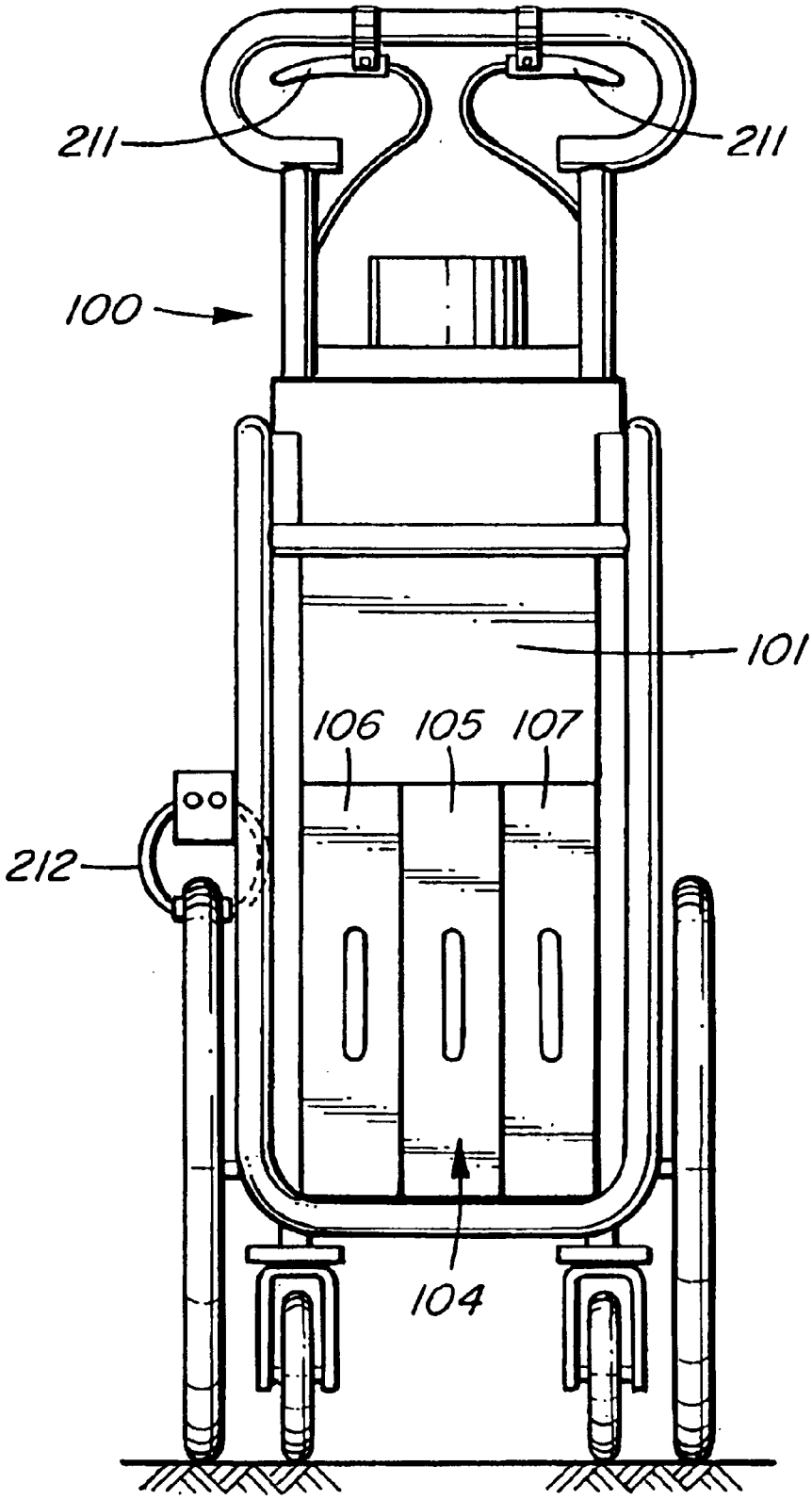
Figure 5A:
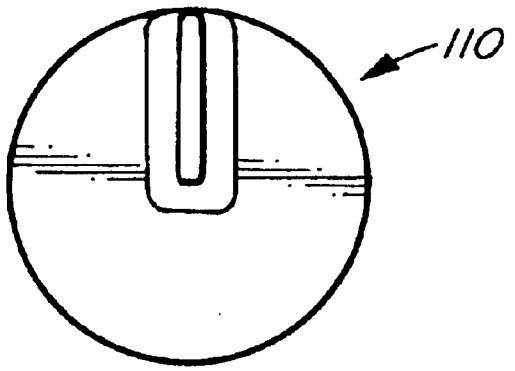
FIGS. 5A, 5B and 5C are top, side and bottom views of a typical parking meter coin collecting cylinder according to the prior art.
Figure 5B:
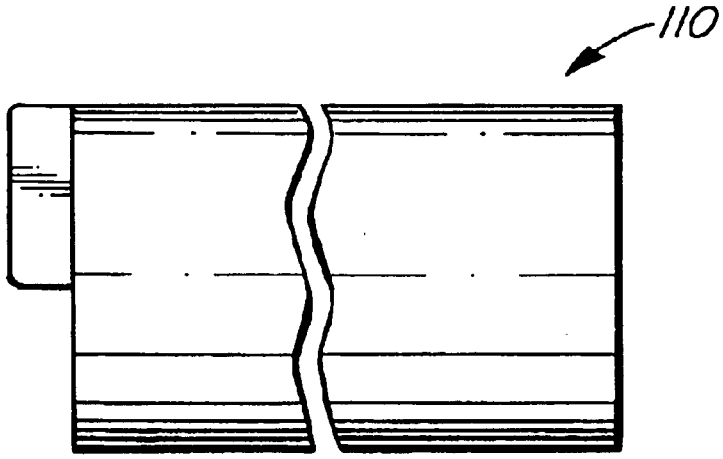
Figure 5C:
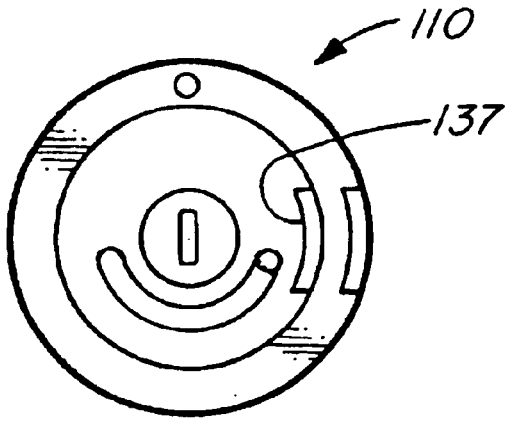

Referring now to the drawings, a coin collecting cart according to the invention is generally illustrated at 100 in FIGS. 1A and 1B. It comprises several different and principal components, namely a main compartment generally illustrated at 101, a coin receiver assembly generally illustrated at 102 for receiving a coin cylinder 110 (FIGS. 5A–5C) of the parking meter (not shown), a frame generally illustrated at 103 for supporting the various components and a collection bin assembly generally illustrated at 104 for holding coins received from the parking meter.

The main compartment 101 (FIG. 2) includes a funnel 111 mounted below the coin receiver assembly 102, a coin chute generally illustrated at 112 which includes rotating panel or gate members 113, 114 with gears 120, 121, respectively, operable to rotate the panel or gage members 113, 114 as will be described, a bin locking assembly generally illustrated at 122 to securely lock the individually bins shown at 105, 106, 107 and generally illustrated at 104, which bin assembly 104 is within the main compartment 101 during coin collection and a battery compartment generally illustrated at 123 for holding a battery 124 used to power the various solenoids, drive motors 132, 133 and other electromechanical components of the coin collecting cart 100.

The coin receiver assembly 102 includes an inner and outer cylinder 130, 131. Inner cylinder 130 rotates relative to outer cylinder 131 when a coin collecting cylinder 110 holding coins and received from the parking meter (not shown) is inserted into the coin receiver 102 as will be described. Inner cylinder 130 includes a spring mounted pin 141 mounted on the outer cylinder 131 which is pressed into a retracted position when the coin collecting cylinder 110 (FIG. 5A) is inserted into the inner cylinder 130. This allows the inner cylinder 130 to rotate relative to the outer cylinder 131.

Figure 2:
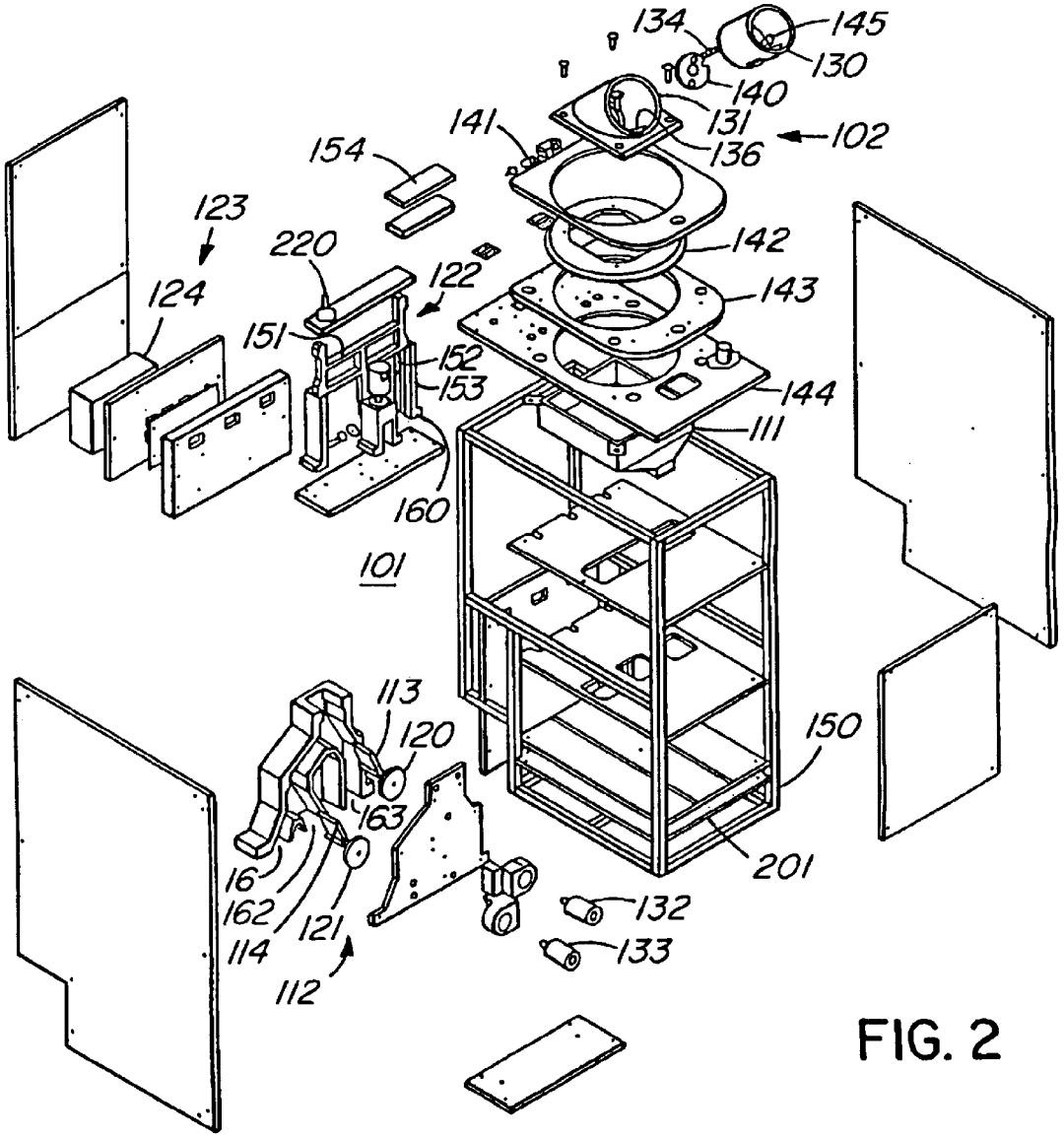
FIG. 2 is a diagrammatic exploded and isometric view of the main compartment of the coin collection cart of FIGS. 1A and 1B.

A recess (not illustrated) on the bottom surface of the base plate 140 (i.e., that surface opposed to the visible surface of the base plate 140 as seen in FIG. 2) allows the entry of the solenoid operated pin 141. The solenoid operated pin 141 removes itself from the base plate 141 when the pin 134 is moved by the entry of the coin collecting cylinder 110. This removal of pin 141 allows the inner cylinder 130 to rotate relative to the outer cylinder 131 and thereby allows coin release from the coin collecting cylinder 110 into the funnel 111 (FIG. 2) and coin chute 112 as will be described. The outer cylinder 131 is securely mounted on a circular rotatable base 142 which, in turn, is mounted for one-hundred-eighty (180) degree rotation about a generally vertical axis within a fixed base 143 which fixed base 143 is connected to a top panel 144 mounted on the frame 150. The rotation of base 142 with outer cylinder 131 allows access for the operator from either side of the coin collecting cart 100.

The bin locking assembly 122 (FIG. 2) includes a reciprocating frame 151 with three (3) pins 152 (only one of which is shown) mounted thereon which move with the frame 151. The reciprocating frame 151 moves vertically in frame guides 153. When the bins 104 are not within the frame 150, the reciprocating frame 151 is in its upper position and when the bins 104 are inserted into the frame 150, a button 220 next to an LCD display 154 is pressed which initiates operation of a motor 160. The motor 160 initiates vertical movement of the reciprocating frame 151 to engage and disengage the pins 152 with corresponding recesses in each of the bins 104.

The coin chute 112 has three exit passageways 161, 162, 163, depending on the position of the panel or gate members 113, 114 which are controlled by the drive motors 132, 133 and which drive motors are controlled, in turn, by the level of the coins in each of the bins 105, 106, 107 making up the bin assembly 104. Exit passageway 162 is the initially used exit passageway. Exit passageway 162 fills the center one 105 (FIG. 1B) of the collection bin assembly 104. When the center one 105 of the collection bin assembly 104 is filled and sensed by the level sensors 165 (FIG. 3) within the bin 105 as will be explained, motor 133 rotates gear 121 with panel or gate member 114 clockwise and the coins will then exit from exit passageway 161 into the leftmost mounted bin 106 of the collection bin assembly 104 as viewed from the front of the coin collector cart 100. Again, when the leftmost bin 106 of the collection bin assembly 104 is filled, motor 132 will be initiated to rotate panel or gate member 113 counterclockwise so as to route the coins through exit passageway 163 into the rightmost mounted one 107 of the collection bin assembly 104.

Figure 3:
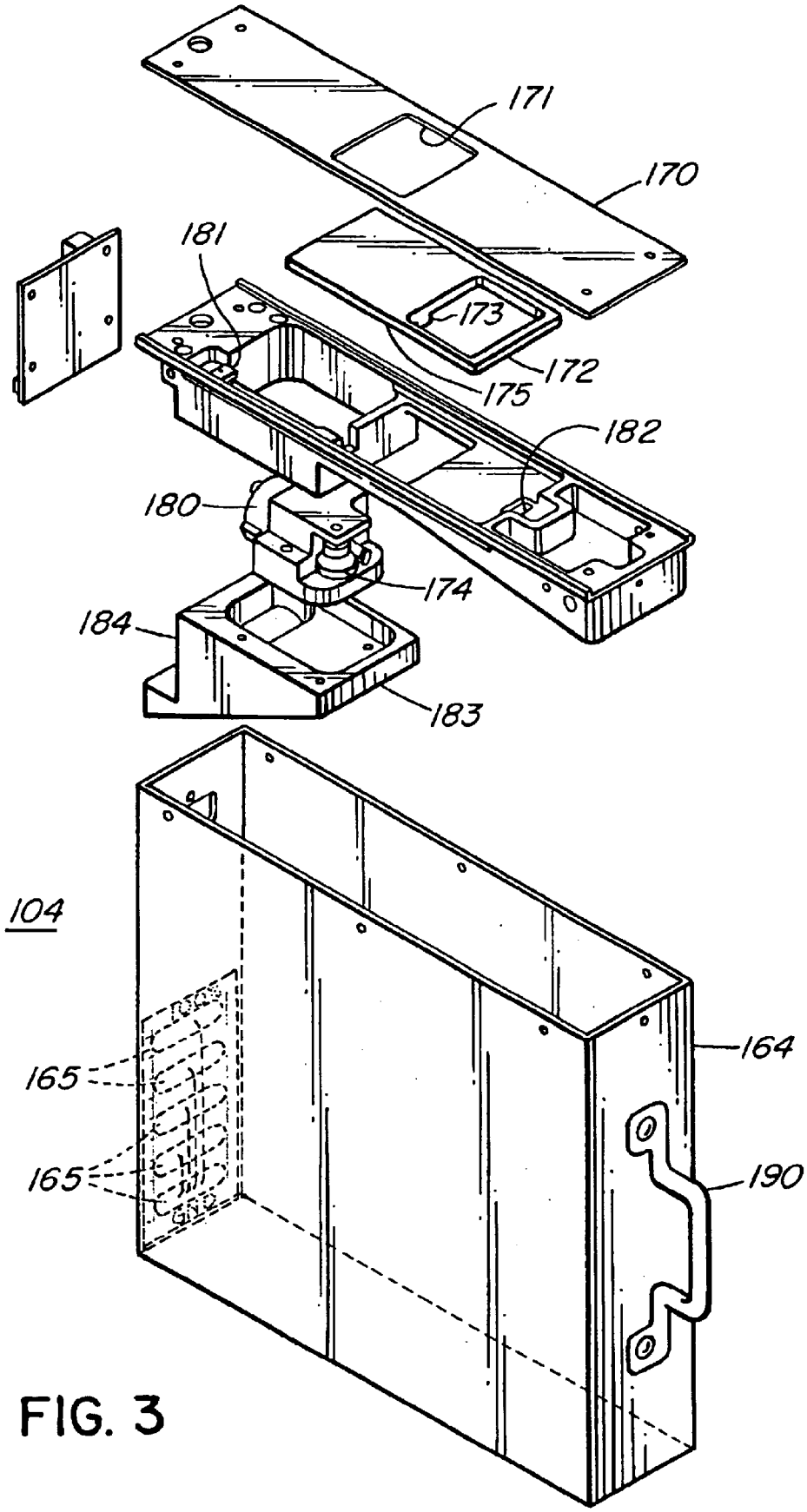
FIG. 3 is a diagrammatic exploded and isometric view of a typical coin collecting bin used with the coin collection cart according to a further aspect of the invention.

The collection bin 104 is illustrated in greater detail in FIG. 3. It comprises a main bin 164 into which the coins pass from the coin funnel 111 (FIG. 2) and in which the coins are held. A series of level sensors 165 sense the depth of coins in the main bin 164 and are adapted to provide that information to the LCD display 154 for viewing by the operator of the coin collection cart 100 as will be described.

A top cover 170 with a window 171 machined therein closes the top of main bin 164. A door 172 reciprocates to open and close the window 171 by using a rack 173 which is moved by pinion gear 174 which pinion gear 174 is driven by DC motor 180 and controlled by micro switches 181, 182 which sense whether the door 172 is in a position where the window 171 is open or where the window 171 is closed.

The motor 180 and the worm gear 174 are mounted in a top backing block 183 which, in turn, is connected to and mounted within main bin 164. Top backing block 183 further has a female connector (not illustrated) in the back portion 184 of the top backing block 183 which female connector receives a male member used to connect the circuitry which is used to sense whether or not a bin 104 is present in the coin collection cart 100 as will be described. A handle 190 for each of the collection bins 104 is provided for ease of handling.

Figure 4:
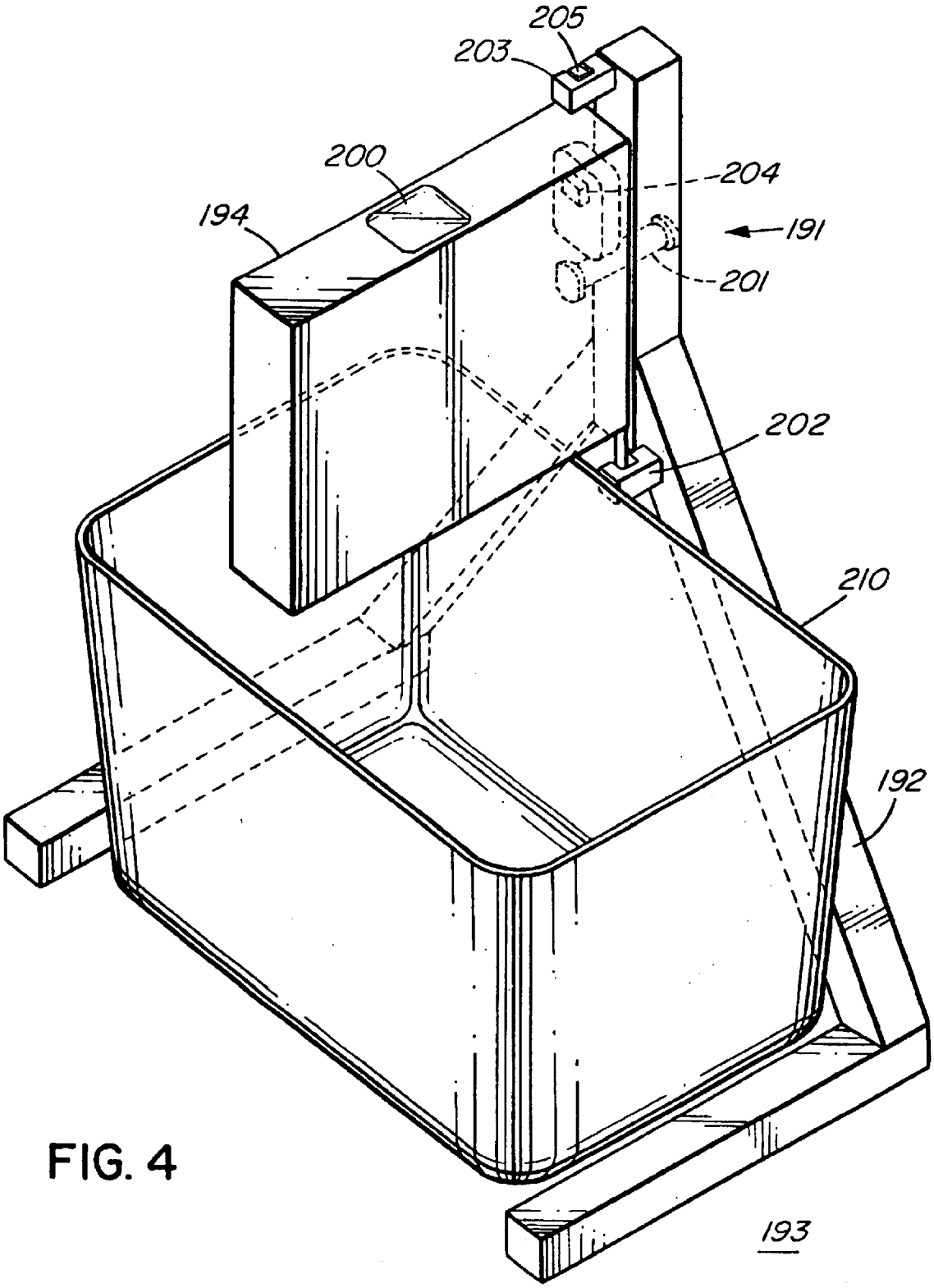
FIG. 4 is a diagrammatic isometric view of the coin unloader for the coin collecting bin according to a further aspect of the invention.

The bin unloading apparatus is generally illustrated at 191 in FIG. 4. It comprises a frame 192 which is securely located on a floor surface 193. A bin holding enclosure 194 with an enclosure window 200 is mounted for rotation about an axis 201. First and second stops 202, 203 are provided to limit the rotation of the bin holding enclosure 194 to one-hundred-eighty (180) degrees. A male member 204 is provided to mate with the female receptacle (not illustrated) in the rear portion 184 of the top backing block 183 (FIG. 3). A holding container 210 is used to hold the coins which pass from window 200 when the bin 104 and the bin holding enclosure 194 are rotated to allow discharge of the coins from the bin 104.

Hand brakes 211 with associated callipers 212 (FIGS. 1 and 2) are provided to maintain the position of the coin collecting cart 100 during operation when the operator must temporarily leave the cart 100 in order to unload the coin collecting cylinder 110 from the parking meter (not shown). A handle 213 rotates about an axis 214 to allow for adjustment of the handle 213 and thereby more comfortable operation of the coin collecting cart 100 by the operator. Castering wheels 108 (FIG. 1A) are provided on frame 150 for load distribution and ease of manoeuvrability of the coin collecting cart 100.

Operation

In operation, it will be assumed that the coin collecting cart 100 has not yet been loaded for the day's activities and that it is being prepared for operation to collect coins from the parking meters which have coins loaded therein.

Figure 6A:
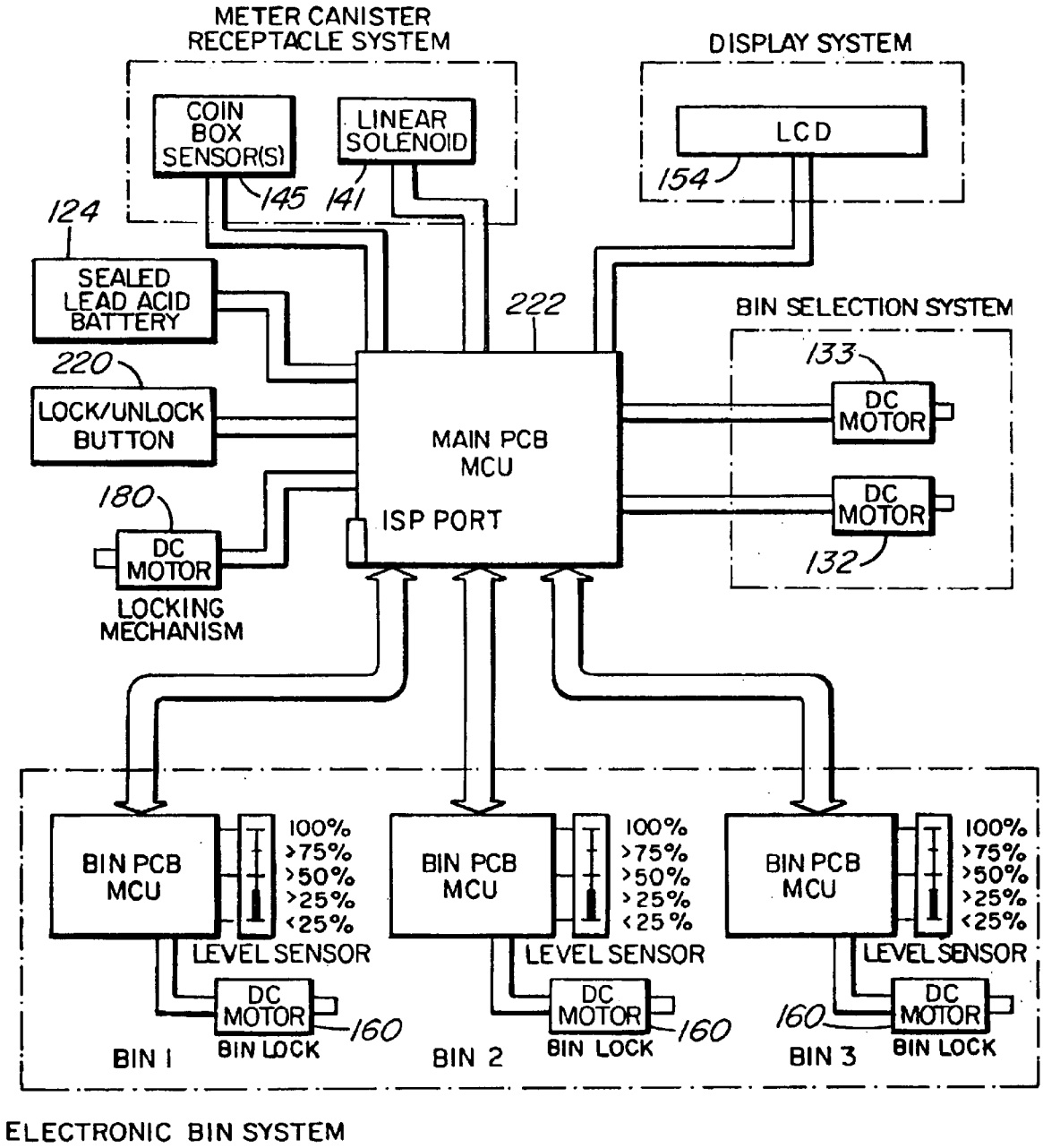
FIGS. 6A and 6B are block diagrams of the electronic system and a flow chart of the operation sequence, respectively.
Figure 6B:
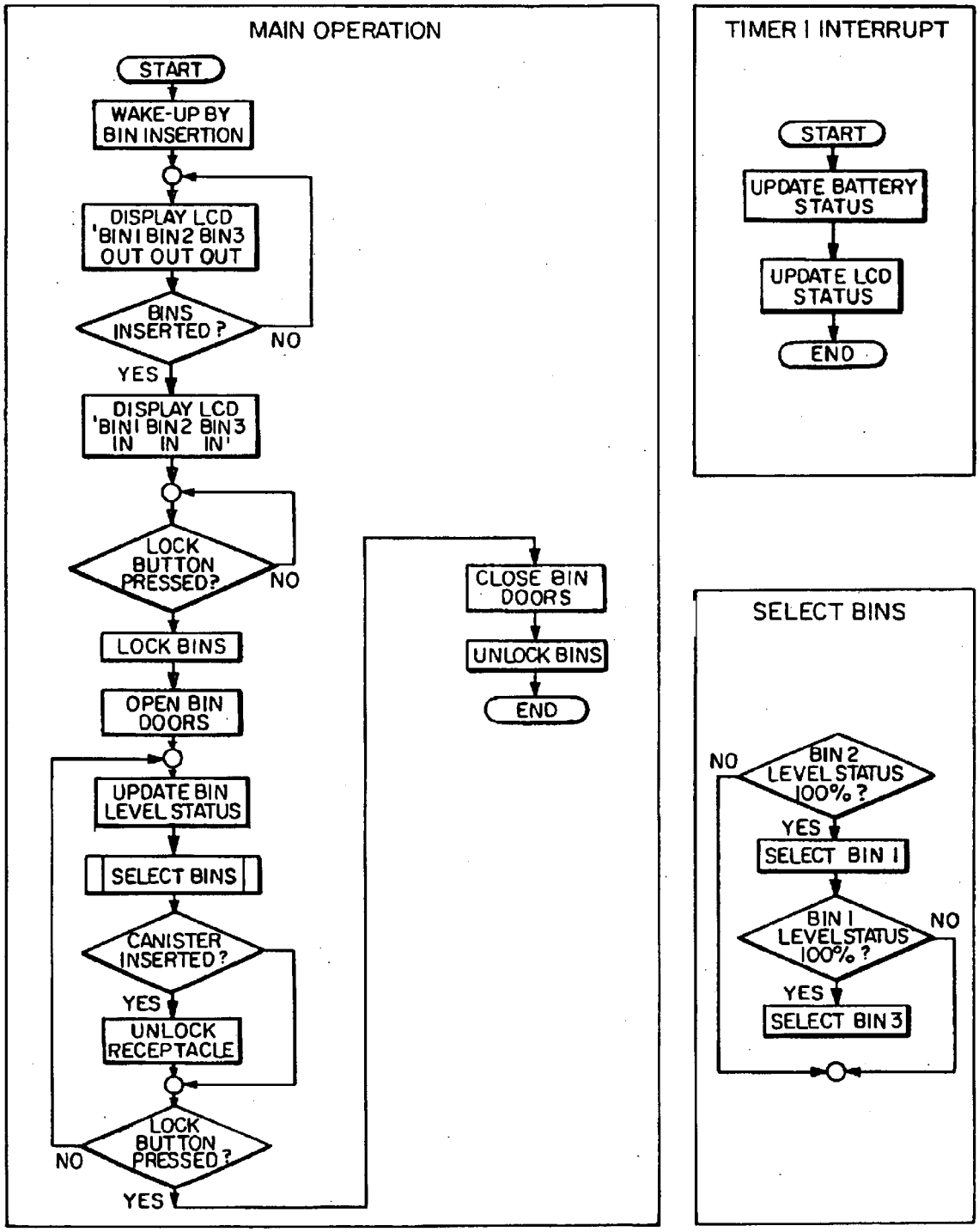

The operator will insert three (3) collecting bins 105, 106, 107 (FIG. 1B) into the coin collecting cart 100 along the bottom panel 201 (FIG. 2) of the frame 150. As each bin 104 reaches the back of the frame 150 following insertion, the female member on the rear portion 184 of the top backing block 183 will allow entry of the male member (not illustrated) on frame 150 thereby initiating a signal to the micro-controller 222 (FIG. 6A) that each of the bins 104 is in its proper position. The LCD 154 will display advice that the bins are secured as seen at 223 in FIG. 6B.

The operator will then push the lock-unlock button 220 (FIGS. 2 and 6A) to initiate operation of motor 160 which, in turn, initiates operation of the bin locking assembly 122 and locks the bins 104 in place within frame 150. Subsequent to the locking step, each motor 180 in each of the bins 104 will be operated to open the respective doors 172 in the bins and thereby align the window 171 in the top cover 170 in each of the bins 105, 106, 107 with the window in the bin door 172 as best seen in FIG. 3.

The operator will proceed to open the parking meters being serviced and to remove the coin collecting cylinder 110 (FIGS. 5A–5C) from the meter. The operator will insert the coin collecting cylinder 110 into the inner cylinder 130 of the coin receiver 102 (FIG. 2).

As the coin collecting cylinder 110 is inserted into the receptacle 130, coin box sensor 145 is moved inwardly. This allows solenoid pin 141 to be removed from the recess (not shown) in the bottom of base plate 140 so that the operator can rotate the coin collecting cylinder 110 relative to the inner cylinder 130 until the window 137 (FIG. 5C) in the coin collecting cylinder 110 is aligned with the window 136 in the inner cylinder 130. The coins within the coin collecting cylinder 110 thereby drop from the cylinder 110 through the window in the inner cylinder and into the funnel 111.

The first bin 105 of the bin assembly 104 to be filled will be the center bin 105 (FIG. 2). This is so because the coin collecting cart 100 will be more stable if the weight of the coins is centered as well as possible. In order for the first bin 105 to be filled, panel or gate member 114 (FIG. 2) will be fully counterclockwise and panel member 113 will be fully clockwise. This will allow coins to pass from the funnel 111 though to exit passageway 162 and thence into bin 105 through the window 171 with the door 172 in the open position. When all the coins are emptied from the coin collection cylinder 110, the cylinder 110 is rotated counterclockwise until its original entry position is reached and then is removed from the inner cylinder 130 and returned to the parking meter.

As the coin collecting operation continues, level sensors 165 (FIG. 3) provide a signal to the LCD 154 advising the operator of the depth of coins within the center bin 105. When the center bin 105 is fully loaded, the micro-controller 222 will initiate operation of the motor 133 which will rotate panel or gate member 114 clockwise. The coins received from a subsequent coin collecting cylinder 110 will thereby be discharged from exit passageway 161 (FIG. 2) into bin 106. When bin 106 is full, as sensed by the level sensors 165, the micro-controller 222 will initiate operation of motor 132 which will rotate panel or gate member 113 counterclockwise and allow coins to exit from exit passageway 163 into bin 107. In this way, the bins 105, 106, 107 of the bin assembly 104 are filled.

When the coin collecting operation is complete or when all of the bins in bin assembly 104 are full, the coin collecting cart 100 will be transported to a secure location for coin unloading. The operator will press lock button 220 which will then close the doors 172 of each of the bins 105, 106, 107 by initiating operation of motors 180 and worm gears 174 operating on rack 175 beneath each door 172. When the doors 172 are closed, all the bins in bin assembly 104 will be unlocked from the frame 150 by operation of motor 160. Each of the bins making up the bin assembly 104 may then be manually removed from the coin collecting cart 100.

The full bins of the bin assembly 104 are then individually inserted into the bin holding enclosure 194. The male and female connectors positioned on the back of the bins 105, 106, 107 and the inner back panel of the bin holding enclosure 194, respectively, will provide power to motor 180 which will then open door 172 and allow the opening to match the window 200 in the bin holding enclosure 194.

The bin holding enclosure 194 together with the individual full individual one of the bins comprising the bin assembly 104 which is mounted therein is then conveniently manually rotated by the user about axis 201 until stop member 202 is reached. In this position, the individual bin of the bin assembly 104 is upside down and the coins within the bin 104 leave the bin 104 through the window in door 172 and the window 200 in the top of the bin holding enclosure 194. The coins pour into the holding container 210 (FIG. 4) and, after the removal of all coins from the individual bins 105, 106, 107 making up the bin assembly 104, the bin holding enclosure 194 is returned to its original position and a button 204 is pressed to close the door on the bin in position. Each bin making up the bin assembly 104 is then removed. The process continues until all the individual bins are empty and it will be understood that there may be many such bins to be unloaded at the end of a day.

Many modifications to the present invention are contemplated. The outer cylinder 131 (FIG. 2) is rotatable approximately one-hundred-eighty (180) degrees about a vertical axis together with the rotatable base 142. This allows for more flexibility for the operator as the coin collecting cylinder 110 may be inserted into the cylinder 131 from either side thus accommodating left and right handed users for example. It is further contemplated that the coin collecting cylinder 110 itself may be designed such that rotation of the cylinder 110 is not required within the receiving cylinder 130. This will be ergonomically attractive since the constant rotation of the coin collecting cylinder 110 in the cylinder 130 creates stress on the wrist and arm of the operator which is desirably avoided.

Many further modifications will readily occur to those skilled in the art to which the invention relates and the specific embodiments described are illustrative of the invention only and should not be taken as limiting its scope as defined in accordance with the accompanying claims.

We claim:

1. A coin cart for parking meter collection comprising a coin receiving receptacle and at least two collection bins for receiving coins from said coin receiving receptacle, each of said collection bins holding a predetermined quantity of coins, each of said collection bins having an opening which is open during said coin receiving and which is closed following removal of said collection bin from said coin cart, said coin receiving receptacle being rotatable by a cannister inserted within coin receiving receptacle, said coin receiving receptacle and said cannister each having an opening, said opening in said cannister allowing access to said opening in said receptacle during said rotation of said cannister within said receptacle, said receptacle having a locking mechanism allowing rotation of said receptacle during insertion and rotation of said cannister and not allowing rotation of said receptacle when said cannister is not present within said receptacle.

2. A coin cart for parking meter collection comprising a coin receiving receptacle and at least two collection bins for receiving coins from said coin receiving receptacle; each of said collection bins holding a predetermined quantity of coins, each of said collection bins having an opening which is open during said coin receiving and which is closed following removal of said collection bin from said coin cart, said coin receiving receptacle being rotatable by a cannister inserted within coin receiving receptacle, said coin receiving receptacle and said cannister each having an opening, said opening in said cannister allowing access to said opening in said receptacle during said rotation of said cannister within said receptacle, said receptacle having a locking mechanism allowing rotation of said receptacle during insertion and rotation of said cannister and not allowing rotation of said receptacle when said cannister is not present within said receptacle and a coin chute to allow said coins to be transferred from said coin receiving receptacle to said at least two collection bins, said coin chute being operable to allow said coins to be transferred from one of said collection bins to a second of said collection bins upon a predetermined quantity of said coins being sensed within said first one of said collection bins.

3. A coin cart for parking meter collection comprising a coin receiving receptacle and at least two collection bins for receiving coins from said coin receiving receptacle, each of said collection bins holding a predetermined quantity of coins, each of said collection bins having an opening which is open during said coin receiving and which is closed following removal of said collection bin from said coin cart, said coin receiving receptacle being rotatable by a cannister inserted within coin receiving receptacle, said coin receiving receptacle and said cannister each having an opening, said opening in said cannister alloying access to said opening in said receptacle during said rotation of said cannister within said receptacle, said receptacle having a locking mechanism allowing rotation of said receptacle during insertion and rotation of said cannister and not allowing rotation of said receptacle when said cannister is not present within said receptacle, a coin chute to allow said coins to be transferred from said coin receiving receptacle to said at least two collection bins, said coin chute being operable to allow said coins to be transferred from one of said collection bins to a second of said collection bins upon a predetermined quantity of said coins being sensed within said first one of said collection bins and an unloading device for said coin cart, said unloading device including a frame operable to receive a collection bin, said frame being rotatable to allow said collection bin to be rotated from an upright to an inverted position.

* * * * *